US005161724A

United States Patent [19]

Radtke et al.

[11] Patent Number: 5,161,724

[45] Date of Patent: Nov. 10, 1992

[54] STAPLING DEVICE FOR SHEET STACKS

[75] Inventors: Manfred Radtke, Korb; Juergen Ries, Nellingen, both of Fed. Rep. of Germany

[73] Assignee: Eastman Kodak Company, Rochester, N.Y.

[21] Appl. No.: 797,625

[22] Filed: Nov. 25, 1991

[30] Foreign Application Priority Data

Jan. 18, 1991 [DE] Fed. Rep. of Germany ..... 4101416

[51] Int. Cl.[5] ..... B42B 4/00

[52] U.S. Cl. ..... 227/1; 227/7

[58] Field of Search ..... 227/7, 142, 3, 1; 270/37, 56

[56] References Cited

U.S. PATENT DOCUMENTS

| | | | |
|---|---|---|---|
| 2,693,595 | 11/1954 | Belluche et al. | 227/3 |
| 2,999,242 | 9/1961 | Young et al. | 227/1 |
| 3,191,925 | 6/1965 | McCain et al. | 227/1 |
| 3,221,965 | 12/1965 | Mestre | 227/7 |
| 3,317,026 | 5/1967 | Zugel et al. | 227/3 X |
| 3,747,824 | 7/1973 | Linden | 227/3 |
| 4,621,757 | 11/1986 | Osako | 227/3 |

*Primary Examiner*—Douglas D. Watts
*Assistant Examiner*—Rinaldi Rada
*Attorney, Agent, or Firm*—Lawrence P. Kessler

[57] ABSTRACT

In a stapling device for sheet stacks 9 in which at least one stapling head 1 is provided whose drive 11 is actuated by a switching mechanism, the switching mechanism cooperating with a sensor sensing the thickness of the sheet stack to be stapled. The sensor has a movable sensing element in the form of a pressure member 17, 25 which, during sensing movement, presses a broadside of sheet stack 9 against an abutment 27 so that the thickness of sheet stack 9, positioned between the abutment 27 and the pressure member 17, 25, limits the path length of the sensing movement of the pressure member 17, 25.

3 Claims, 2 Drawing Sheets

STAPLING DEVICE FOR SHEET STACKS

BACKGROUND OF THE INVENTION

The invention relates, in general, to a stapling device for sheet stacks and, more particularly, to a stapling device in which the thickness of the stack to be stapled is secured by a movable sensing element cooperating with such stack, the movement of the sensing element depending on its path length determined by the thickness of the stack and serving to control actuation of a stapling head of the device.

Stapling devices for use in automated apparatus typically include at least one stapling head, a drive means for the stapling head, a switching means actuating the drive means of the stapling head to perform the stapling operation. Further, such stapling devices may include a sensor which cooperates with the switching means such that the stapling operation is blocked when a sheet stack of an inadmissible thickness is present (see for example U.S. Pat. No. 3,317,026). Such sensor, and its cooperation to control the stapling operation, are of complex construction.

SUMMARY OF THE INVENTION

This invention is directed to a sheet stack thickness sensor for a stapling device of the general type which is of a particularly simple construction. According to the invention, the sensor is a pressure member which urges a broadside of the stack against an abutting surface so that the thickness of the sheet stack located between the abutting surface and the pressure member confines the length of the sensing path of the pressure member. The sheet stack, urged against the abutting surface with a broadside thereof by the pressure member, forms a stop with its opposite broadside, the stop defining the end of the path of movement of the pressure member. As the position of the sensing surface is determined by the thickness of the stack, and the length of the sensing movement covered by the pressure member, up to the stop, is indicative of the thickness of the stack. As a result, the sensing movement of the pressure member can be utilized to produce a signal which actuates the drive means of the stapling device. In this way, failsafe control of the staples device is achieved using very simple mechanism.

A particularly simple, embodiment is achieved if the device is provided with an electric switch in the form of a simple OFF/ON switch cooperating with the sensing device. The OFF/ON switch will always be actuated by the sensing movement of the pressure member when the length of the path of movement of the pressure member is sufficiently long, i.e., when the thickness of the stack does not exceed a predetermined maximum. This embodiment can be applied particularly advantageously when it is of importance to prevent a stapling operation in the case of the sheet stacks which are too thick and to staple sheet stacks of admissible stack thickness. This is, for example, the case with stapling devices arranged downstream of the sheet exit of copiers. In a switching mechanism for example, featuring an electric switch, the switch may be actuated (on) directly by the movement of the pressure member, the switching procedure being released when the pressure member moves sufficiently far up to the end of the path of movement. If, on the other hand, the stack thickness exceeds a predetermined value, i.e., if the length of the movement of the pressure member up to standstill is too short, the switch is not actuated (OFF).

According to an advantageous embodiment, the pressure member may be designed as part of a lifting means having a power drive connected to the pressure member in order to lift the sheet stack from a sheet support by mean of the pressure member and to contact its broadside facing away from the sheet support with an anvil for the stapling operation. This embodiment has the advantage that the sensing movement, except for controlling the switching mechanism, can also place the sheet stack for the stapling operation on an anvil located above the sheet support. In this case, the stapling head(s) can perform the stapling operation from bottom to top. This is advantageous if the stapled sheet stacks are folded to form booklets as is, for example, the case with so-called saddle stitchers. In the case of the staples being shot in from below, the stapled sheet stack can be drawn downward through the gap of folding rollers, the sheets being upwardly folded. When using an electric switch, the pressure member can act directly on its movable switch contact or form part of the contact element itself which contacts an accordingly arranged counter-contact when the sensing movement is performed with a sufficient length of path.

The invention, and its objects and advantages, will become more apparent in the detailed description of the preferred embodiment presented below.

BRIEF DESCRIPTION OF THE DRAWINGS

Further features and advantages can be inferred from the description of embodiments of the invention illustrated in the drawings and from the subclaims. The drawings show:

DESCRIPTION OF THE PREFERRED EMBODIMENT

Figure 2:
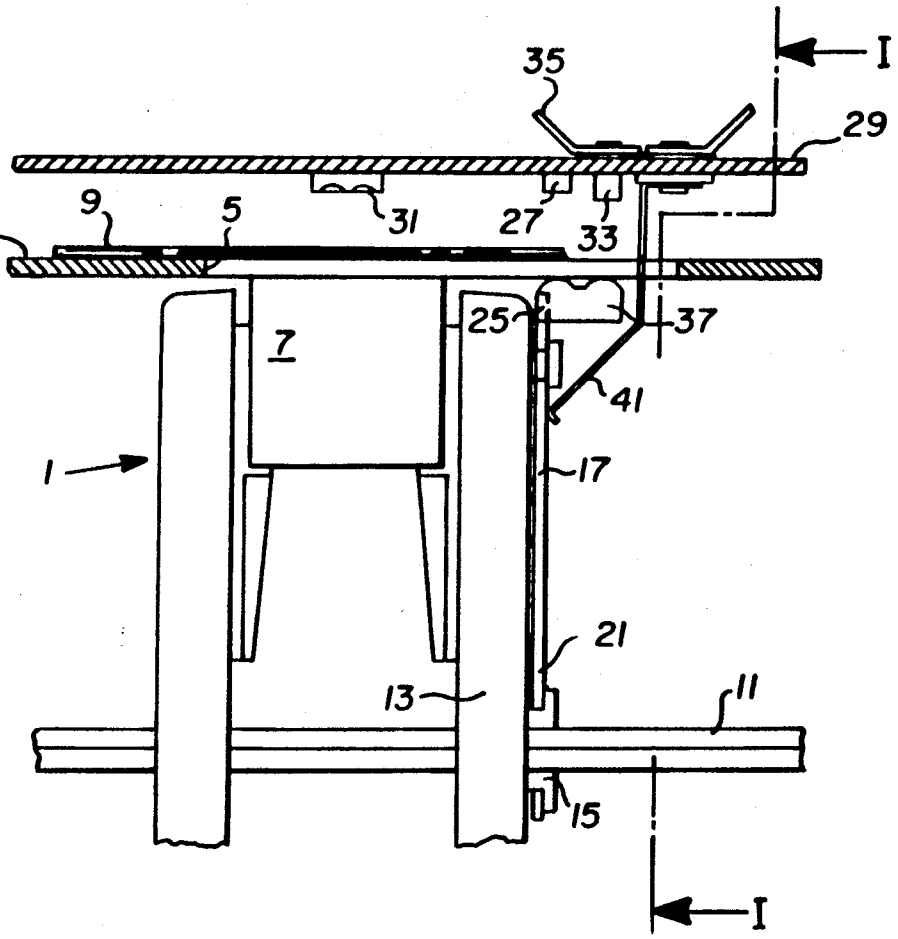
FIGS. 1 and 2 show a cross-section and a longitudinal section, respectively, of the sheet stack thickness sensor according to this invention in the area of the stapling station (broken and partly schematically simplified, the cutting lines being designated II—II and I—I, respectively, and movable parts being shown in their home positions.
Figure 1:
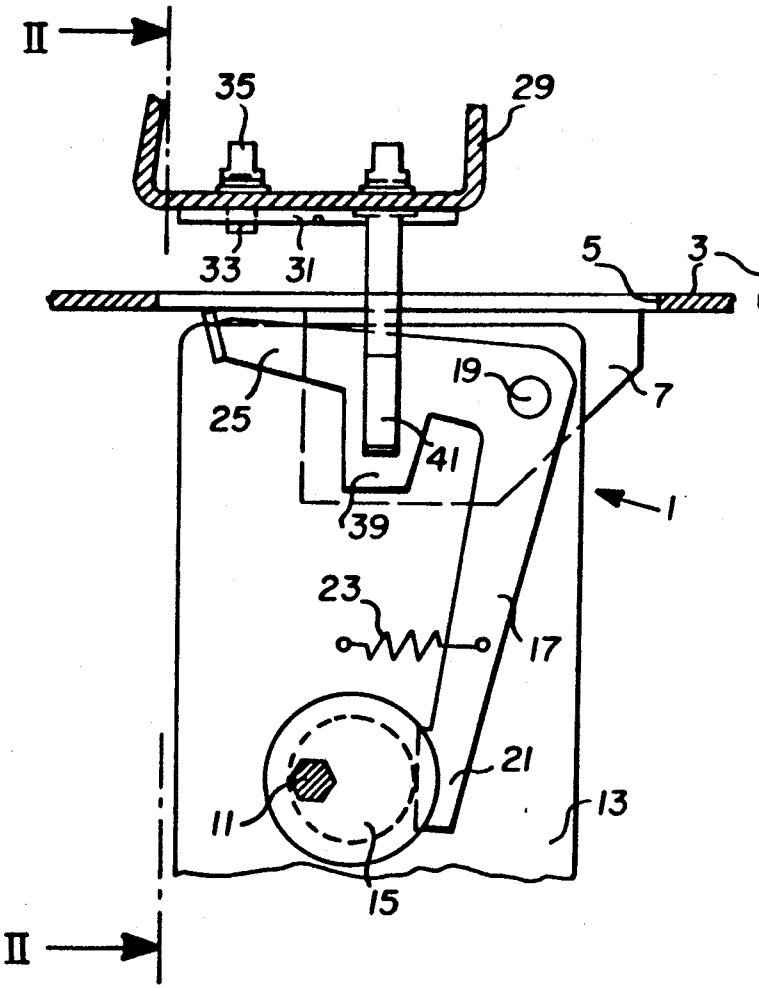

The figures show part of the stapling station of the two available stapling heads, only one designated 1 as a whole being visible. Stapling head 1 is arranged below a sheet support 3 having an aperture 5 through which a movable member 7 of stapling head 1 can reach to perform the stapling operation illustrated in FIGS. 3 and 4 in which the movable parts take their sensing or stapling positions. FIGS. 1 and 2 show those parts in their home positions, the movable member 7 of stapling head 1 being retracted below aperture 5 of sheet support 3. A sheet stack 9 to be stapled (FIGS. 2 to 4) is moved on support 3 to a predetermined position required for the stapling operation.

Figure 4:
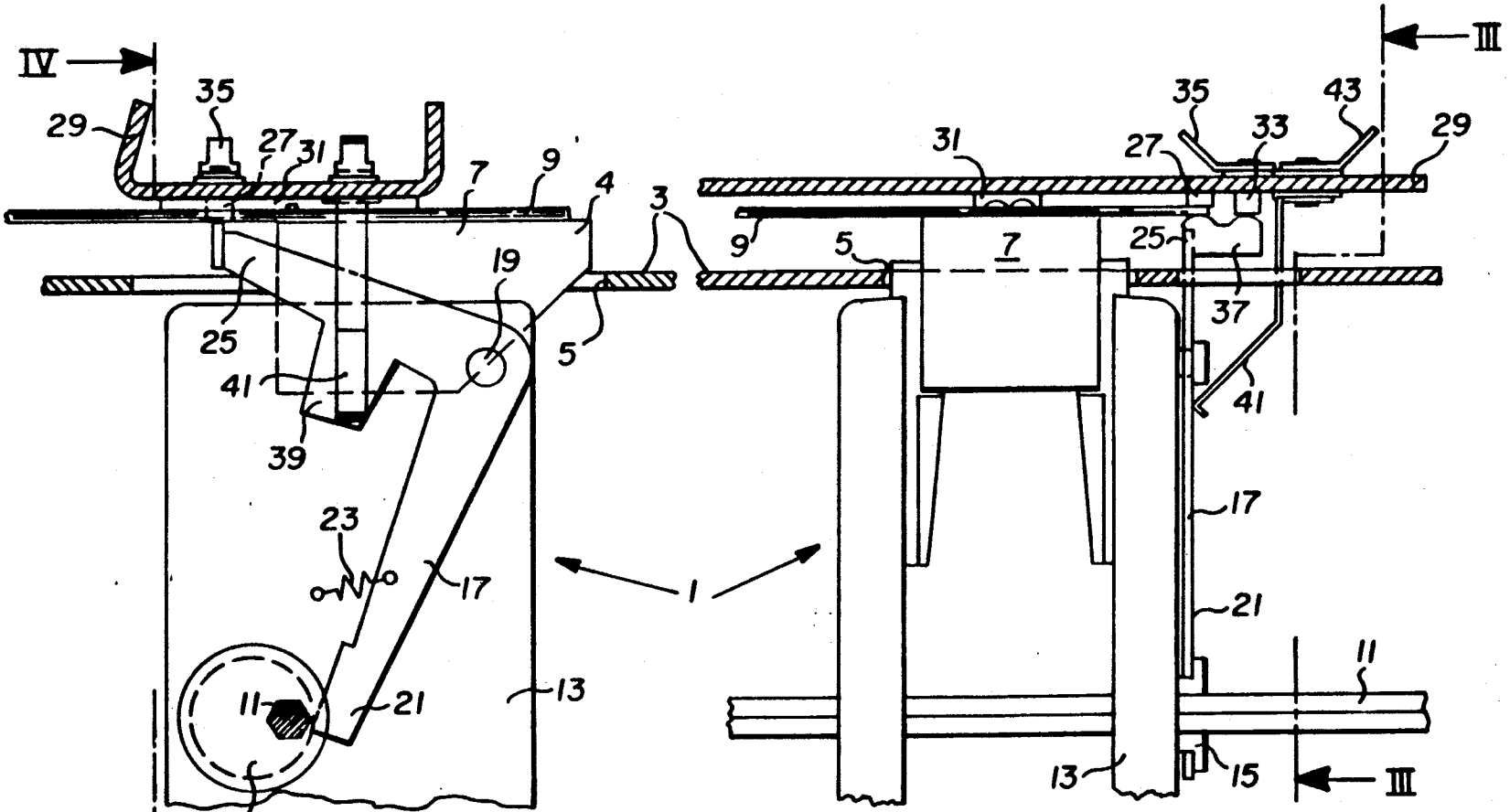
FIGS. 3 and 4 show representations corresponding to FIGS. 1 and 2, the cutting lines being designated IV—IV and III—III, respectively, and the movable part being shown in sensing position.
Figure 3:
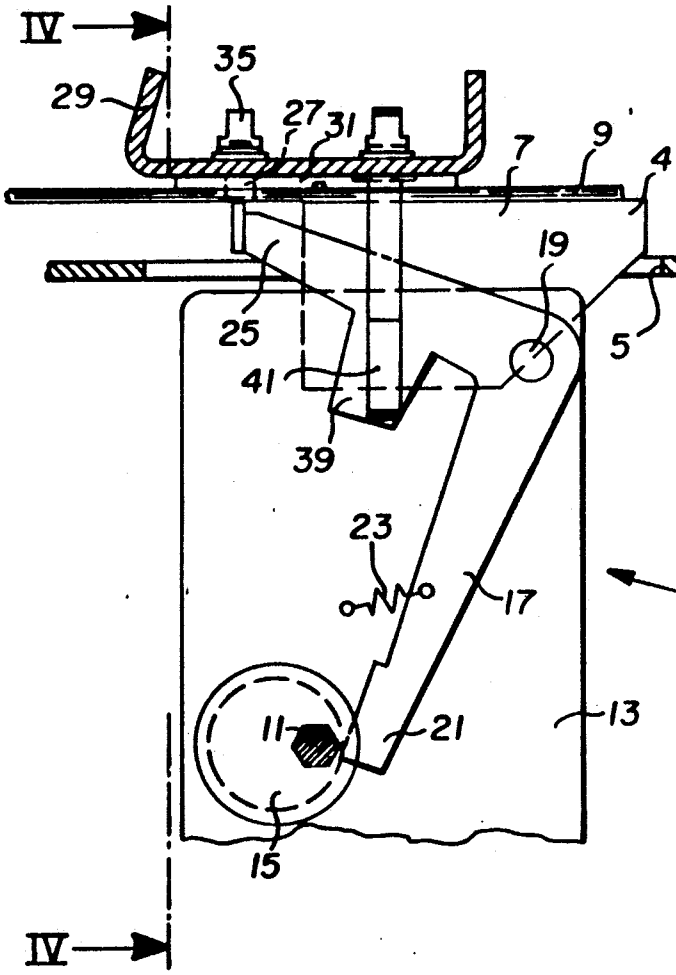

Stapling head 1 is actuated by means of a mechanical rotary drive having a drive shaft 11 which is motor-driven and performs a complete revolution per stapling operation. By means of a gear arrangement (not shown) providing in housing 13 of stapling head 1, the rotary movement of drive shaft 11 is converted in a way typical for stapling heads into a drive for the stapling mechanism and for the movement of the movable member 7 of stapling head 1. A cam 15 is mounted on drive shaft 11 outside housing 13 of head 1. An arm 21 of an angular lever 17 cooperates with said cam 15, such level 17 being supported by a pin 19 on the periphery of housing 13 for pivotal movement about an axis extending parallel to the drive shaft 11 of cam 15. Angular lever 17, whose arm 21 is urged into contact with the control surface of cam 15, is formed such that its second arm 25 extends through aperture 5 of sheet support 3 when arm 21, forming the cam follower, is in contact with the cam section closest to the camshaft axis of cam 15. This is illustrated in FIGS. 3 and 4. In this position of cam 15, angular lever 17, with its arm 25 extending through aperture 5 of sheet support 3, forms, with the aid of the force of spring 23, a pressure member. The pressure member acts on sheet stack 9 lying on sheet support 3 from below, lifts sheet stack 9 and urges it with one of its broadsides against a contact surface of an abutment 27 located on a support 29 extending above sheet support 3 parallel and in spaced relation thereto.

In a position aligned with the movable member 7 of stapling head 1, the support 29 also carries an anvil 31 on its bottom side facing sheet support 3. The anvil 31, for the stapling operation, cooperates in the well known manner with the staple ejected by the movable member 7 of stapling head 1. During upward movement of arm 25 of angular lever 17 serving as a pressure member, sheet stack 9 is not only urged against the contact surface of abutment 27 but, at the same time, contacts anvil 31 with its broadside.

Electrically insulated from support 29, a counter-contact 33 is arranged on the side of support 29 facing sheet support 3, the counter-contact 33 being provided with an electrical connecting tag 35. Arm 25 of angular lever 17 has a lug 37 which is used as a movable contact element cooperating with counter-contact 33 when sheet stack 9 is pressed against abutment 27 by arm 25. The arrangement of lug 37 and counter-contact 33 relative to each other is selected such that there will be no contact between lug 37 and counter-contact 33 if the stack is in admissibly thick for a satisfactory stapling operation, i.e., if the sheet stack located between arm 25 and abutment 27 blocks upward movement of arm 25 before the arm, and thus lug 37, has covered a sufficient length of path. The angular leer 17 forming, with its arm 25 and lug 37, the movable contact element cooperating with an electrical connector which is provided with a contact spring 41 sliding on a contact lug 39 of the metallic angular lever 17. The contact spring 41 is retained on support 29, electrically insulated relative thereto, and provided with a connecting tag 43 to enable completion of an electrical circuit which provides a signal and thus serves as an OFF/ON switching mechanism for the stapling device 1.

When the stapling device is in operation, the pressure movement of arm 25 serves as a sensing movement for sensing the thickness of sheet stack 9, an electric signal being produced when counter-contact 33 contacts lug 37 to complete the electrical circuit, if the stack thickness does not exceed an admissible value. If such signal is produced, the switching mechanism of the device is actuated (OH) causes the drive shaft 11 to continue its rotational movement to complete a full revolution required for the stapling operation. In this case, a staple is ejected from member 7 of the stapling head which has upwardly extended through aperture 5. If, in the case of an inadmissible thickness of the stack, no contact is made between lug 37 and counter-contact 33 and the electrical circuit is not completed i.e., if no activating signal for the stapling operation is produced, the switch mechanism is not actuated (OFF) and the stapling device is de-energized prior to staple ejection.

The above description and the drawings are confined to features which are essential to the invention. Those features which are disclosed in the description and in the drawing but are not mentioned in the claims also serve for defining the subject matter of the invention, if required.

We claim:

1. In a stapling device for stapling sheet stacks (9), such device including at least one stapling head (1), an anvil (31), drive means (11, 15) for driving said stapling head into operative associated with said anvil, and means for sensing the thickness of a sheet stack (9( to be stapled and selectively actuating said drive means in response to such thickness sensing, said sensing means comprising:

an abutment surface (27), a first electrical contact (33) adjacent to said abutment surface, a sensing element (17, 25) cooperating with said drive means, said sensing element including a pressure member is movable by said drive means when said drive means drives said stapling head towards its operative associated with said anvil to urge a broadside of the stack (9) against said abutment surface (27) so that the thickness of the sheet stack (9) is located between said abutment surface and said pressure member and establishes the length of movement of the pressure member, and a second electrical contact (37) mounted on said pressure member for movement therewith, said second electrical contact contacting said first electrical contact only when such sheet stack is equal to or less than a predetermined thickness to complete an electrical circuit producing a signal enabling actuation of said drive means to effect stapling of such sheet stack by said stapling head.

2. Stapling device as defined in claim 1 further including a third electrical contact (41) mounted in sliding engagement with said pressure member.

3. Stapling device as defined in claim 1 wherein said drive means for said stapling head (1) includes a rotary drive shaft (11), a cam (15) mounted for rotation with said rotary drive shaft, a spring (23) urging said pressure member for movement toward the broadside of the sheet stack facing it, said cam having a profile by which said pressure member is moved away from the sheet stack (9) against the force of said spring (23).

* * * * *